US011878840B2

(12) United States Patent
Andersson

(10) Patent No.: US 11,878,840 B2
(45) Date of Patent: Jan. 23, 2024

(54) METHOD OF PRODUCING A PACKAGING CONTAINER AND A PACKAGING CONTAINER

(71) Applicant: AR Packaging Systems AB, Lund (SE)

(72) Inventor: Rickard Andersson, Lund (SE)

(73) Assignee: GPI Systems AB, Lund (SE)

( * ) Notice: Subject to any disclaimer, the term of this patent is extended or adjusted under 35 U.S.C. 154(b) by 209 days.

(21) Appl. No.: 17/623,957

(22) PCT Filed: Jul. 1, 2020

(86) PCT No.: PCT/SE2020/050691
§ 371 (c)(1),
(2) Date: Dec. 30, 2021

(87) PCT Pub. No.: WO2021/002797
PCT Pub. Date: Jan. 7, 2021

(65) Prior Publication Data

US 2022/0363427 A1 Nov. 17, 2022

(30) Foreign Application Priority Data

Jul. 2, 2019 (SE) ..... 1950831-6

(51) Int. Cl.
*B65D 3/14* (2006.01)
*B65B 1/02* (2006.01)
*B65B 1/04* (2006.01)

(52) U.S. Cl.
CPC ..... *B65D 3/14* (2013.01); *B65B 1/02* (2013.01); *B65B 1/04* (2013.01)

(58) Field of Classification Search
CPC ..... B65D 3/10–14
(Continued)

(56) References Cited

U.S. PATENT DOCUMENTS 1,064,787 A 6/1913 Taylor
1,396,282 A 11/1921 Penn
(Continued)

FOREIGN PATENT DOCUMENTS

CH 280201 A 1/1952
CN 88102720 A 11/1988
(Continued)

OTHER PUBLICATIONS

Search Report for PCT/SE2020/050691 dated Sep. 11, 2020. 4 pgs.
Supplementary European Search Report for EP 20 83 4315 dated Aug. 16, 2023.

*Primary Examiner* — Nathan J Newhouse
*Assistant Examiner* — Phillip D Schmidt
(74) *Attorney, Agent, or Firm* — Womble Bond Dickinson (US) LLP

(57) ABSTRACT

A method of forming a paperboard packaging container from a rectangular body blank is disclosed, the method including the following steps:

a) providing a rectangular body blank made from a laminate sheet material;
b) forming a tubular container body from the rectangular body blank, the container body having a first end with a first body opening and a second end with a second body opening;
c) sealing together the first and the second side edge in a but-to-but seal using a sealing strip having a sealing strip width;
d) presenting the tubular container body to a crease line forming station;
e) closing the second body opening by pressing a paperboard disc into the second body opening;
f) forming a curled second edge by folding or rolling the second end of the container body wall inwardly;
g) filling the packaging container with bulk solids; and
(Continued)

h) closing the first body opening.

16 Claims, 4 Drawing Sheets

(58) Field of Classification Search
USPC ..... 229/4.5, 5.5, 5.6, 5.8, 93, 97, 400–405
See application file for complete search history.

(56) References Cited

U.S. PATENT DOCUMENTS 1,515,277 A 11/1924 Root
1,733,674 A 10/1929 Leiman
1,916,519 A * 7/1933 Madsen ..... B65D 3/10 229/5.5
2,073,636 A 3/1937 Holoubek
2,076,407 A 4/1937 Mandell
2,281,854 A 5/1942 Miller, Jr.
2,314,338 A 3/1943 Graves
2,317,651 A 4/1943 Talbot
2,324,670 A 7/1943 Bergen
2,348,377 A 5/1944 Goodyear
2,371,173 A 3/1945 Hothersall
2,409,655 A 10/1946 Annen
2,568,697 A 9/1951 Amberg
2,569,851 A 10/1951 Farrell
2,608,341 A 8/1952 Eckman
2,760,629 A 8/1956 Thagard, Jr.
2,795,366 A 6/1957 Magill
2,891,713 A 6/1959 O'Neil
2,898,025 A 8/1959 Walker
2,948,454 A 8/1960 Gillmore
3,006,522 A * 10/1961 Arneson ..... B65D 3/10 229/5.5
3,042,285 A 7/1962 Smith
3,042,288 A 7/1962 Carpenter, Sr.
3,049,277 A 8/1962 Shappell
3,101,885 A 8/1963 Walsh
3,109,576 A 11/1963 Karl
3,195,763 A 7/1965 Fried et al.
3,195,799 A 7/1965 Denenberg
3,401,824 A 9/1968 Rouse
3,402,876 A 9/1968 Kuchenbecker
3,409,206 A 11/1968 Slouka et al.
3,445,049 A 5/1969 Carpenter, Jr.
3,506,183 A 4/1970 Turpin et al.
3,655,111 A 4/1972 Surerus
3,669,346 A 6/1972 Leezer et al.
3,696,987 A 10/1972 Schuff
3,923,233 A * 12/1975 Smith ..... B65D 3/14 229/5.5
3,940,496 A 2/1976 Turpin et al.
4,078,686 A 3/1978 Karesh
4,091,929 A 5/1978 Krane
4,091,984 A 5/1978 McFarland
4,198,901 A 4/1980 Knudsen
4,207,725 A 6/1980 Smith
4,210,618 A 7/1980 Piltz
4,303,190 A * 12/1981 Ditto ..... B65D 3/14 229/5.6
4,495,209 A 1/1985 Whiteside
4,533,063 A 8/1985 Buchner et al.
4,556,152 A 12/1985 Bogren
4,606,462 A 8/1986 Bogren
4,621,736 A 11/1986 Roccaforte
4,632,298 A 12/1986 Schellengerg
4,736,870 A 4/1988 Christensson
4,804,101 A 2/1989 Heath
4,850,503 A 7/1989 Larsson
4,865,203 A 9/1989 Ueda
4,883,193 A 11/1989 Christensson
4,888,222 A 12/1989 Gibbons
4,921,121 A 5/1990 Duvander et al.
5,487,506 A 1/1996 Drummond et al.
5,514,394 A 5/1996 Lenahan
5,566,529 A 10/1996 Sireix
5,617,705 A 4/1997 Sanfilippo et al.
5,641,118 A 6/1997 Benham
5,685,480 A 11/1997 Choi
5,752,646 A 5/1998 Sandstrom
5,803,294 A 9/1998 Bello et al.
5,820,016 A 10/1998 Stropkay
5,897,019 A 4/1999 Stropkay
5,950,917 A 9/1999 Smith
6,047,878 A 4/2000 Lowry
6,092,717 A 7/2000 Lowry
6,165,114 A 12/2000 Stahlecker et al.
6,251,203 B1 6/2001 Vala et al.
6,415,940 B1 7/2002 Brabson, II
6,450,351 B1 9/2002 Thompson
6,644,541 B2 11/2003 Stewart
6,761,279 B1 7/2004 Martin et al.
7,169,418 B2 1/2007 Dalton
7,201,714 B2 4/2007 Zoeckler et al.
7,370,788 B1 5/2008 Otani et al.
7,798,319 B1 9/2010 Bried
8,025,171 B2 9/2011 Cassol
8,220,701 B2 7/2012 Fontaine et al.
8,317,671 B1 11/2012 Zoeckler
8,403,819 B2 3/2013 Zoeckler
8,403,820 B2 3/2013 Zoeckler
8,684,224 B2 4/2014 House
8,915,395 B2 12/2014 Gersovitz
9,387,963 B2 7/2016 McBroom
9,718,574 B2 8/2017 Sireix
9,815,579 B2 11/2017 Larsson et al.
9,821,527 B2 11/2017 Hagelqvist
9,975,305 B2 5/2018 Strand et al.
10,370,158 B2 8/2019 Herlin et al.
10,730,660 B2 8/2020 Herlin et al.
10,736,468 B2 8/2020 Herlin et al.
10,787,280 B2 9/2020 Herlin et al.
11,111,062 B2 9/2021 Herlin et al.
11,192,688 B2 12/2021 Herlin et al.
2002/0107127 A1 8/2002 Buisson
2002/0130126 A1 9/2002 Rosenberg
2003/0111522 A1 6/2003 Deering et al.
2003/0183540 A1 10/2003 Onishi
2004/0050437 A1 3/2004 Engel et al.
2004/0142133 A1 7/2004 De Coninck
2004/0206052 A1 10/2004 Shean
2004/0238553 A1 12/2004 Lane et al.
2005/0051461 A1 3/2005 Bryant
2005/0173501 A1 8/2005 Jones
2005/0189406 A1 9/2005 Welchel et al.
2005/0190995 A1 9/2005 Koyanagi
2005/0223680 A1 10/2005 Sireix
2005/0252952 A1 11/2005 Nomula
2006/0057315 A1 3/2006 De Coninck et al.
2006/0108409 A1 * 5/2006 Pyper ..... B65D 3/14 229/5.5
2006/0124719 A1 6/2006 Mannlein
2006/0254942 A1 11/2006 Cargile, Jr.
2006/0257534 A1 11/2006 Maddock
2006/0289542 A1 12/2006 Schedl
2007/0090105 A1 4/2007 Elgebrant
2007/0145001 A1 6/2007 Tilto
2007/0157577 A1 7/2007 Buisson
2007/0234667 A1 10/2007 Lubker et al.
2008/0041861 A1 2/2008 Crawford et al.
2008/0110896 A1 5/2008 Westphal
2008/0156805 A1 7/2008 Perry et al.
2008/0156808 A1 7/2008 Perry et al.
2009/0039078 A1 2/2009 Sanfilippo et al.
2009/0177179 A1 7/2009 Engelbrecht
2009/0236346 A1 9/2009 Hofeldt et al.
2009/0314775 A1 12/2009 Dietrich et al.
2010/0018883 A1 1/2010 Patel
2010/0065557 A1 3/2010 Gersovitz
2010/0108670 A1 5/2010 Perry et al.
2010/0133127 A1 6/2010 Jenner
2010/0140129 A1 6/2010 Sanfilippo et al.
2010/0142862 A1 6/2010 Sam
2010/0180553 A1 7/2010 Tilton

(56) References Cited

U.S. PATENT DOCUMENTS

| | | | |
|---|---|---|---|
| 2010/0270301 | A1 | 10/2010 | Cronin |
| 2010/0308044 | A1 | 12/2010 | Perry et al. |
| 2010/0308065 | A1 | 12/2010 | Vandamme et al. |
| 2010/0308066 | A1 | 12/2010 | Perry et al. |
| 2011/0006066 | A1 | 1/2011 | Vandamme et al. |
| 2011/0253725 | A1 | 10/2011 | Killian |
| 2012/0103353 | A1 | 5/2012 | Sebastian et al. |
| 2012/0125932 | A1 | 5/2012 | Sierra-Gomez |
| 2012/0298733 | A1 | 11/2012 | Xu et al. |
| 2013/0029823 | A1 | 1/2013 | Zoeckler |
| 2013/0048125 | A1 | 2/2013 | Hoffman et al. |
| 2013/0092312 | A1 | 4/2013 | Cassoni |
| 2013/0186901 | A1 | 7/2013 | Lejon et al. |
| 2014/0109522 | A1 | 4/2014 | Sanfilippo |
| 2014/0262903 | A1 | 9/2014 | Mitten |
| 2014/0287901 | A1 | 9/2014 | Hagelqvist |
| 2015/0038309 | A1 | 2/2015 | Hoffman et al. |
| 2015/0148208 | A1 | 5/2015 | Sireix |
| 2016/0000270 | A1 | 1/2016 | Wiggins et al. |
| 2017/0073142 | A1 | 3/2017 | Loomis et al. |
| 2017/0247159 | A1 | 8/2017 | Hansen |
| 2017/0283136 | A1 | 10/2017 | Branyon |
| 2017/0297769 | A1 | 10/2017 | Gersovitz |
| 2018/0016038 | A1 | 1/2018 | Herlin et al. |
| 2018/0022505 | A1 | 1/2018 | Herlin et al. |
| 2018/0194527 | A1 | 7/2018 | Sasaki et al. |
| 2018/0311940 | A1 | 11/2018 | Toft et al. |
| 2019/0127107 | A1 | 5/2019 | Herlin et al. |
| 2021/0070520 | A1 | 3/2021 | Huffer |
| 2021/0206544 | A1 | 7/2021 | Holka et al. |
| 2022/0135260 | A1 | 5/2022 | Larsson |

FOREIGN PATENT DOCUMENTS

| | | | | |
|---|---|---|---|---|
| CN | 1914096 | A | | 2/2007 |
| CN | 2915695 | Y | | 6/2007 |
| CN | 101391493 | A | | 3/2009 |
| CN | 201338810 | | | 11/2009 |
| CN | 101754912 | | | 6/2010 |
| CN | 102190118 | A | | 9/2011 |
| CN | 101670909 | B | | 1/2012 |
| CN | 102991764 | A | | 3/2013 |
| CN | 103895952 | A | | 7/2014 |
| CN | 103979180 | A | | 8/2014 |
| CN | 104812680 | A | | 7/2015 |
| CN | 107108068 | A | | 8/2017 |
| CN | 206954829 | U | | 2/2018 |
| CN | 108438412 | A | * | 8/2018 |
| CN | 208559788 | U | | 3/2019 |
| DE | 884862 | C | | 7/1953 |
| DE | 3411371 | A1 | | 10/1985 |
| DE | 10 2014 000 543 | A1 | | 7/2015 |
| EP | 0 013 132 | A1 | | 7/1980 |
| EP | 0 062 929 | A2 | | 10/1982 |
| EP | 0 094 359 | A2 | | 11/1983 |
| EP | 109050 | A | * | 5/1984 ..... B65D 3/10 |
| EP | 0 104 548 | B1 | | 6/1987 |
| EP | 0 312 513 | A2 | | 4/1989 |
| EP | 0 370 982 | A1 | | 5/1990 |
| EP | 0 611 703 | A2 | | 8/1994 |
| EP | 1 818 259 | A2 | | 8/2007 |
| EP | 1 842 792 | B1 | | 10/2008 |
| EP | 2 716 551 | A1 | | 4/2014 |
| EP | 2 719 637 | A1 | | 4/2014 |
| EP | 2 731 874 | A1 | | 5/2014 |
| EP | 2 927 132 | A1 | | 10/2015 |
| EP | 3 085 636 | A1 | | 10/2016 |
| EP | 3 095 600 | A1 | | 11/2016 |
| EP | 3162553 | A1 | | 5/2017 |
| EP | 3 409 470 | A1 | | 2/2018 |
| EP | 3 342 720 | A1 | | 7/2018 |
| EP | 3 409 470 | A1 | | 12/2018 |
| EP | 3 442 875 | | | 2/2019 |
| EP | 3 481 727 | | | 5/2019 |
| EP | 3 546 387 | | | 10/2019 |
| EP | 3 578 477 | | | 12/2019 |
| FR | 1358396 | A | | 4/1964 |
| FR | 828311 | A | | 5/1983 |
| FR | 2716408 | A1 | | 8/1995 |
| FR | 2981333 | A1 | | 4/2013 |
| FR | 2986514 | A1 | | 8/2013 |
| FR | 3043069 | | | 5/2017 |
| GB | 1911 00947 | A | | 12/1911 |
| GB | 819960 | A | | 9/1959 |
| GB | 920354 | A | | 3/1963 |
| GB | 998102 | A | | 7/1965 |
| GB | 1038995 | A | | 8/1966 |
| GB | 2 281 895 | A | | 3/1995 |
| GB | 2526548 | A1 | | 12/2015 |
| JP | S60501305 | A | | 8/1985 |
| JP | S61217350 | A | | 9/1986 |
| JP | S6375 | A | | 1/1988 |
| JP | H0285118 | A | | 3/1990 |
| JP | H05-58640 | U | | 8/1993 |
| JP | H09-99939 | A | | 4/1997 |
| JP | H09-290822 | A | | 11/1997 |
| JP | 3025434 | B2 | | 3/2000 |
| JP | 2001030383 | A | | 2/2001 |
| JP | 2003231191 | A | | 8/2003 |
| JP | 2004-001884 | A | | 1/2004 |
| JP | 2004-026197 | A | | 1/2004 |
| JP | 2004-155478 | A | | 6/2004 |
| JP | 2004-315094 | A | | 11/2004 |
| JP | 2004-535993 | | | 12/2004 |
| JP | 2005-041515 | | | 2/2005 |
| JP | 2005-219319 | | | 8/2005 |
| JP | 2005-333802 | | | 12/2005 |
| JP | 3843510 | B2 | | 11/2006 |
| JP | 2007-145415 | A | | 6/2007 |
| JP | 2010-284866 | A | | 12/2010 |
| JP | 2015-174690 | | | 10/2015 |
| JP | 2016-084169 | A | | 5/2016 |
| JP | 2016-088524 | A | | 5/2016 |
| JP | 2016-179849 | A | | 10/2016 |
| JP | 2019-137067 | | | 8/2019 |
| JP | 2020-039532 | A | | 3/2020 |
| KR | 10-2007-0113467 | | | 11/2005 |
| SE | 453821 | B | | 3/1988 |
| SE | 1651162 | A1 | | 3/2018 |
| SU | 1433404 | A3 | | 10/1988 |
| WO | WO 84/04511 | A1 | | 11/1984 |
| WO | WO 87/03536 | A1 | | 6/1987 |
| WO | WO 03/039201 | | | 5/2003 |
| WO | WO 2004/060767 | A1 | | 7/2004 |
| WO | WO 2005/032959 | A1 | | 4/2005 |
| WO | WO 2005/075314 | A2 | | 8/2005 |
| WO | WO 2006/068585 | A1 | | 6/2006 |
| WO | WO 2009/130043 | | | 10/2009 |
| WO | WO 2013/009227 | A1 | | 1/2013 |
| WO | WO 2013/057392 | A1 | | 4/2013 |
| WO | WO 2013/109174 | A1 | | 7/2013 |
| WO | WO 2014/062119 | A1 | | 4/2014 |
| WO | WO 2015/145600 | | | 10/2015 |
| WO | WO 2015/145601 | | | 10/2015 |
| WO | WO 2015/187004 | A1 | | 12/2015 |
| WO | WO 2016/030071 | A1 | | 3/2016 |
| WO | WO 2016/034462 | A1 | | 3/2016 |
| WO | WO 2016/126191 | A1 | | 8/2016 |
| WO | WO 2016/126193 | A1 | | 8/2016 |
| WO | 2017180056 | A1 | | 10/2017 |
| WO | WO 2017/180056 | A1 | | 10/2017 |
| WO | WO 2018/009128 | A1 | | 1/2018 |
| WO | WO 2018/009130 | A1 | | 1/2018 |
| WO | WO 2018/009134 | | | 1/2018 |
| WO | WO 2018/009138 | A1 | | 1/2018 |

* cited by examiner

METHOD OF PRODUCING A PACKAGING CONTAINER AND A PACKAGING CONTAINER

CROSS-REFERENCE TO RELATED APPLICATIONS

This application is a national phase entry under 35 U.S.C. § 371 of International Application No. PCT/SE2020/050691, filed on Jul. 1, 2020, published in English, which claims priority to European Patent Application No. 1950831-6, filed on Jul. 2, 2019, the disclosures of which are hereby incorporated herein by reference.

TECHNICAL FIELD

The present disclosure pertains to a method of producing a paperboard packaging container and a paperboard container produced by the method.

BACKGROUND

In the area of disposable containers for products such as infant formula, tobacco, detergents, etc. there is an ongoing need of diminishing the carbon footprint of such products, by minimizing the resource use for the disposable containers as well as making the containers recyclable. The disposable containers referred to herein are composite containers having a tubular body which is made from a laminate sheet material comprising a carton layer, i.e. a layer made predominantly from cellulosic fibres. The upper and lower end edge of the container may include a plastic rim connected to the edges of the packaging container. This provides the packaging containers with a pleasant and neat appearance and the container top or bottom may also be more wear resistant. The bottom of the container may alternatively be made from a folded-in end portion of the tubular body or may be a bottom disc which is attached to the tubular body at the bottom end. The appearance may however for such packaging containers be somewhat less attractive and less wear resistant at the bottom end of the packaging container.

To improve the appearance and stability of the packaging container bottom or upper end, an end portion of the container body wall may be curled inwardly providing a curled bottom or upper edge.

An object of the present disclosure is to improve the curled end edge(s) of paperboard packaging container.

SUMMARY

The above object may be achieved with a method of forming a paperboard packaging container according to claim 1 and by a paperboard packaging container according to claim 10.

A method of forming a paperboard packaging container from a rectangular body blank as set out herein includes the following steps:

a) providing a rectangular body blank, the body blank having a longitudinal direction and a transverse direction, the body blank having a first transverse edge and a second transverse edge and a first and a second side edge, an inside surface and an outside surface, the body blank being made from a laminate sheet material comprising a carton substrate layer, the body blank comprising two or more parallel crease lines, the two or more parallel crease lines extending along the second transverse edge between respective first and second line end points, the respective first line end points each being arranged with a distance of from 2 mm to 15 mm from the first side edge and the respective second line end points each being arranged with a distance of from 2 mm to 15 mm from the second side edge;

b) forming a tubular container body from the rectangular body blank, the container body having a first end with a first body opening and a second end with a second body opening and a container body wall extending in a height direction of the packaging container between the first body opening and the second body opening, the height direction of the packaging container corresponding to the longitudinal direction of the body blank, the container body wall having an inner surface and an outer surface, a first end edge and a second end edge;

c) sealing together the first and the second side edge, i.e. from the first end edge to the second end edge, in a but-to-but seal using a sealing strip, the sealing strip extending, as seen in a width direction thereof, over a non-creased area bridging the first and the second side edge and extending between the first and second end points of the two or more parallel continuous crease lines, as seen in a circumferential direction of the paperboard packaging container corresponding to the transverse direction of the body blank;

d) presenting the tubular container body to a crease line forming station and providing the non-creased area which is bridged over by the sealing strip and extending between the respective first and second end points with two or more bridging crease lines such that a crease line area is formed, extending in the circumferential direction;

e) closing the second body opening by pressing a paperboard disc into the second body opening, the paperboard disc having a peripheral flange being flexed towards the second end in the height direction of the paperboard packaging container and attaching the peripheral flange of the bottom disc to the inner surface of the container wall;

f) forming a curled second edge by curling the second end of the container body wall inwardly, at the two or more parallel crease lines and at the bridging crease line area, the curled second edge comprising an edge portion and an inner portion;

g) filling the packaging container with bulk solids;

h) closing the first body opening, such as with a transport closure and/or a lid component; and, i) wherein steps h) and subsequently step g) could alternatively come after step d).

The crease line forming station may form the crease lines by pressing a crease line forming tool into the rectangular body blank such that two or more compressed crease lines are formed in the material.

The curled second edge may be a curled bottom edge, meaning that the second transverse edge is a bottom edge, the second body opening is a bottom body opening, the second end edge is a bottom end edge and the paperboard disc is a bottom disc.

The curled second edge may be a curled upper edge, meaning that the second transverse edge is an upper edge, the second body opening is an upper body opening, the second end edge is an upper end edge and the paperboard disc is a top disc.

A stable upper and/or bottom container edge may be of importance for providing an enhanced stackability for the packaging container during transport and storage.

Instead of attaching a plastic rim to the bottom edge and/or to the upper edge of the packaging container and thereby including plastic components to the packaging container, a stable packaging container bottom and/or top may be obtained by forming of a curled bottom and/or upper edge by folding or rolling the bottom end/upper end of the container body wall inwardly, thereby also avoiding the need for plastic components which renders the recycling of the packaging container more difficult. It has however been found by the present inventors that the curled bottom edge and/or curled upper edge may not be as neat as desired due to the relatively rigid and thick paperboard material structure. However, as the body blank is provided with two or more parallel crease lines extending in the transverse direction from a respective first to a respective second line end point and are arranged at a location intended to being curled for providing the curled edge, the crease lines formed by for example by applying pressure to the paperboard material breaks the fibers in the structure and renders the curling more controlled and provides a more distinct curled edge. The parallel crease lines extend in the transverse direction and in proximity to the transverse edge of the body blank. The crease line arranged closest to the transverse edge is provided with a distance of between 1 and 10 mm from the transverse edge of the body blank, as seen in the longitudinal direction. Each of the crease lines may be arranged with a distance to the adjacent crease line, as seen in the longitudinal direction, of from 0.5 to 4 mm, this meaning that each crease line may be arranged with a distance to the adjacent crease line of from 0.5 to 4 mm, as measured in the longitudinal direction.

As the side edges are to be sealed in a but-to-but seal the border regions along the side edges need to be free from crease lines to attach the sealing strip in a tight and durable manner. Hence, the non-creased area has the same width or a greater width than a width of the sealing strip, as measured in a circumferential direction of the paperboard packaging container. This has however in a later step been found by the present inventors to cause a less distinct curling of the end edge at the curling step in the area around the but-to-but seal. To overcome this defect, an additional step has been included of forming bridging crease lines in the non-creased area which is bridged by the sealing strip and extending between the respective first and second end points with two or more bridging crease lines such that a bridging crease line area is formed. This has been found to significantly enhance the curled bottom edge and provide a neatly curled bottom edge around the entire circumference of the packaging container.

The sealing strip may be sealed to border regions along the side edges by means of gluing or welding, with welding being preferred. The welding may be high frequency welding.

The two or more continuous and parallel crease lines and the two or more bridging crease lines may each have a depth of from 40 μm to 400 μm, as measured from the outer surface of the container wall and in a direction towards the inner surface of the container wall.

As used herein, a paperboard material is a sheet material predominantly made from cellulose fibers or paper fibers. The sheet material may be provided in the form of a continuous web or may be provided as individual sheets of material. The paperboard material may be a single ply or multi ply material and may be a laminate comprising one or more layers of materials such as polymeric films and coatings, metal foil, etc. The polymeric films and coatings may include or consist of thermoplastic polymers. The paperboard material may be coated, printed, embossed, etc. and may comprise fillers, pigments, binders and other additives as known in the art. The paperboard materials as disclosed herein may also be referred to as cardboard or carton materials.

The tubular container body may be formed to have a front wall portion, a rear wall portion and two side wall portions, being connected by corner portions. The corner portions of the tubular body may be rounded corner portions. The rectangular body blank side edges may be sealed together in a but-to-but seal in one of the two side wall portions.

The tubular body may alternatively have a circular cross-section. The tubular body may also have an essentially square, triangular or oval cross-section.

The sealing strip is preferably welded to the inside surface of the tubular body by means of high frequency induction welding. Application of container components such as a top sealing member, a bottom disc and a top rim may be performed using an attachment unit comprising a welding unit, such as a high frequency welding unit, which is configured to fasten the component to the tubular body during production of the composite container. The welding unit may comprise an inductive welding energy generator for softening or melting a weldable layer that forms part of the tubular body and/or the applied container component. The sealing strip may also be adhesively attached to the inside surface of the tubular body, the attachment unit may in such case comprise a gluing unit. The sealing strip may of course be attached by any other suitable means. The sealing strip may for example be made of a laminate film including an aluminium layer, a polyethylene layer and a polyester layer.

The paperboard disc may be attached to the tubular body by welding the peripheral flange of the paperboard disc to the inside surface of the tubular body. The peripheral flange is created by folding an edge portion of the paperboard disc out of the plane of the paperboard disc and into alignment with the inside surface of the tubular body. The paperboard disc is applied at a distance from the second end edge of the tubular body to allow forming the curled second edge by curling the second end.

The body blank in step a) may comprise three or more parallel crease lines and wherein step d) may include providing the non-creased area which is bridged by the sealing strip and extending along the second transverse edge between the respective first and second end points with three or more bridging crease lines to form a crease line area between the respective first and second end points. The three or more parallel crease lines, and the three or more bridging creasing lines, are arranged in proximity to the second transverse edge of the body blank and such that the crease lines are arranged at the intended folding or rolling for providing the curled second edge. The provision of three or more parallel crease lines in combination with the provision of three or more parallel bridging crease lines, may provide an improved folding of the curled second edge, as the crease lines may be provided continuously around the curled portion and a more symmetric and distinct curl may be achieved. The lower contact surface of the curled edge, i.e. being in contact with for example a shelf or the like, may also be more distinct and smaller and the stability and risk for a soiled and damaged curled bottom edge is therefore reduced. If the second edge is an upper edge the fact that the upper edge is more distinct and smaller enhances the stackability and the wear resistance of the edge.

Step f) may include folding or rolling the second end of the container body wall inwardly and over the peripheral flange of the paperboard disc. This may provide an improved stability to the curled second edge as the curled edge in a transverse direction has an increased thickness. Additionally, as the inner portion of the curled edge is provided over the peripheral flange, the edge of the peripheral flange is covered by the curled edge and may not interfere with the bottom or upper edges of another packaging container when being stacked. Therefore, the stackability of the paperboard packaging container is improved.

The inner portion of the curled second edge may have a height as measured in the height direction of from 2 mm to 20 mm. The fact that the inner portion has a height of from 2 mm provides an area which is sufficiently large for pressing the inner portion from the inside and towards the outside and against the inner wall of the tubular body, thereby forming a neatly inwardly curled portion.

A distance between adjacent crease lines of the two or more, or three or more, parallel crease lines may be between 0.5 and 4 mm, as seen in the height direction of the packaging container.

A distance between adjacent bridging crease lines of the two or more, or three or more, parallel bridging crease lines may be between 0.5 and 4 mm, as seen in the height direction of the packaging container.

Distances between the adjacent crease lines and/or the adjacent bridging crease lines of between 0.5 and 4 mm have been found advantageous in forming a distinct curled edge. In particular when three or more crease lines and three or more bridging crease lines are arranged at the curled second edge.

The two or more bridging crease lines may be slightly offset with the two or more parallel crease lines while the tubular container body still is provided with two or more crease lines continuously along the circumference of the tubular container body, as seen in a height direction of the packaging container.

The two or more bridging crease lines may alternatively be aligned with the two or more parallel crease lines such that the two or more bridging crease lines and the two or more parallel crease lines form two or more closed loops around the circumference of the tubular container body.

The fact that the tubular container body at the curled edge is provided continuously, as seen in a height direction, around the circumference of the curled second edge, such as at the edge portion and at a transition area of the edge portion and the inner portion of the curled edge and/or a transition area between the edge portion and the container wall, provides a distinct and symmetric curled edge.

A paperboard packaging container for bulk solids as disclosed herein comprises a tubular container body, a container bottom and a container lid. The container body extends in a height direction of the container from a first end to a second end. The tubular container body also comprises a container body wall, the container body wall having an inner surface facing towards an inner compartment in the packaging container and an outer surface facing away from the inner compartment. The container body wall furthermore has a first end edge and a second end edge and is made by a laminate sheet material comprising a carton substrate layer. The tubular container body comprises a but-to-but joint extending in the height direction and the but-to-but joint is sealed by a sealing strip. A second body opening at the second end of the tubular body is closed by a paperboard disc having a peripheral flange being flexed towards the second end in the height direction and attached to the inner surface of the container body wall. The second end of the container body wall is curled inwardly providing a curled second edge comprising an edge portion and an inner portion. The container wall is provided with two or more circumferential and parallel crease lines, each extending in a circumferential direction of the packaging container between a first and a second end point arranged at each side of the sealing strip, the container wall furthermore comprises a bridging crease line area extending over the sealing and between the respective first and second end points of the two or more circumferential and parallel crease lines. The bridging crease line area includes two or more bridging crease lines. The two or more circumferential and parallel crease lines and the two or more bridging crease lines being arranged at the curled second edge.

The inner portion of the curled edge may have a height of from 2 mm to 20 mm, as measured from the edge portion of the curled edge and a distal edge of the inner portion of the curled edge, the distal edge of the inner portion corresponding to the second transverse edge of the body blank.

The container wall may at the curled second edge and along a circumference of the tubular container body be provided with three or more circumferential and parallel crease lines extending in a circumferential direction of the tubular container body. The bridging crease line area may furthermore include three or more bridging crease lines.

The tubular container body may be provided with two or more, or three or more, crease lines continuously along the circumference of the tubular container body, as seen in a height direction of the packaging container. The two or more, or three or more, bridging crease lines may be slightly offset with the two or more, or three or more, parallel crease lines, i.e. the two more bridging crease lines may not be completely aligned with the parallel crease lines as seen in a circumferential direction.

The two or more circumferential and parallel crease lines may in combination with the two or more bridging crease lines be arranged continuously and at every giving point along a circumference of the tubular container body, thus being aligned with each other and forming two or more closed loops.

Three or more circumferential and parallel crease lines may in combination with three or more bridging crease lines be provided continuously along a circumference of the tubular container body, as seen in a height direction of the packaging container.

Distances between the adjacent crease lines and/or the adjacent bridging crease lines of between 0.5 and 4 mm have been found advantageous in forming a distinct curled edge. In particular when three or more crease lines and three or more bridging crease lines are arranged at the curled end edge.

In a further aspect, the method according to the present disclosure may also include curling both the upper and bottom edges of the container wall. In such method the body blank in step a) furthermore is provided with two or more parallel crease lines extending along the first transverse edge between respective third and fourth line end points, the respective third line end points each being arranged with a distance of from 2 mm to 15 mm from the first side edge and the respective fourth line end points each being arranged with a distance of from 2 mm to 15 mm from the second side edge. Step d) moreover includes providing a second non-creased area which is bridged by the sealing strip and extending between the respective third and fourth line end points of the two or more parallel crease lines extending along the first transverse edge with two or more bridging crease lines such that a second bridging crease line area is formed. Step h) includes closing the first body opening by pressing a paperboard disc into the first body opening, the paperboard disc having a peripheral flange being flexed towards the first end in the height direction of the paperboard packaging container and sealing the peripheral flange of the paperboard disc to the inner surface of the container wall. The method additionally includes a step of forming a curled first edge by curling the first end of the container body wall inwardly, at the two or more parallel crease lines arranged along the first transverse edge.

For the method of forming a paperboard packing container having both a first and a second curled end edge, the steps of forming the first curled edge may include all features disclosed for the method of forming the second curled edge. Similarly, for the packaging container including both a curled second edge and a curled first edge, the first curled edge may include some or all of the features disclosed for the second curled edge.

An example of a packaging container suitable for having both a curled upper and a curled bottom end is disclosed in WO 2017/180056. The packaging container in this patent application is of the plug-in lid typ, being formed of a paperboard top disc and the container wall and by cutting an at least partly circumferential cut along the circumference of the container body thereby separating an upper portion forming the plug-in lid.

The composite container as disclosed herein may comprise a top sealing member which is attached to the inside surface of the tubular body at a distance from the top end of the tubular body.

The packaging container may in step h) be provided with a top sealing member. The top sealing member may be an openable or peelable top sealing member, implying that it may be fully or partly removed by a user in order to provide initial access to an interior compartment of the composite container either by breaking a seal between the top sealing member and the inside surface of the tubular body, or by tearing or otherwise breaking the top sealing member itself.

The top sealing member may be gastight or gas-permeable. A gastight top sealing member may be manufactured from any material or material combination suitable for providing a gastight sealing of a compartment delimited by the sealing membrane, such as aluminium foil, silicon-coated paper, carton, plastic film, or laminates thereof. A gastight top sealing member is particularly advantageous when the contents in the composite container are sensitive to air and/or moisture.

The top sealing member may be attached to the tubular body by welding a peripheral flange of the top sealing member to the inside surface of the tubular body. As disclosed herein, the top sealing member is commonly a flexible component made from a laminate of one or more layers of aluminium foil and outer layers of thermoplastic polymeric material and the peripheral flange is created by folding an edge portion of the top sealing member out of the plane of the top sealing member and into alignment with the inside surface of the tubular body. The top sealing member is applied at a distance from the top end edge of the tubular body to allow for attachment of the top rim above the top sealing member. If the composite container comprises a scoop, a leaflet, or other supplementary item, the top sealing member may be applied at a sufficient distance from the top end edge of the tubular body to allow the item to be accommodated in a space formed between the top sealing member and an inside surface of the lid.

Depending on whether the top sealing member is applied from the upper end of the tubular body or from the bottom end of the tubular body, the flange of the top sealing member which is joined to the inside surface of the tubular body may be directed upward toward the container opening or downward, toward the bottom end of the composite container.

The top sealing member may constitute a transport seal and is provided in addition to the openable and closable lid, to keep the contents in the composite container fresh and protected against contamination up until a first opening of the composite container by a consumer.

A peelable top sealing member commonly takes the form of a flexible foil which may be provided with a grip tab or other gripping device for facilitating removal of the top sealing member.

The lid of the composite container as disclosed herein may be a part of a lid component, the lid component comprising the top rim and a lid part.

Alternatively, the lid may be a separate part of the composite container which can be completely removed when opening the composite container, such as a plug-in lid.

When the lid is part of a lid component, it is connected to the top rim by means of a hinge. The hinge may be a live hinge, i.e. a bendable connection between the lid and the top rim or frame structure. A live hinge may be formed integrally with the lid and/or with the top rim or frame structure or may be a separately formed element which is attached to the lid and to the top rim or frame structure. Alternatively, the hinge may be a two-part hinge, with a first hinge part arranged on the lid and a second hinge part arranged on the top rim or frame structure.

The composite containers as disclosed herein are containers for dry or moist goods, often referred to as "bulk solids". Such products are non-liquid, generally particulate materials capable of being poured, scooped or taken by hand out of the cans. The containers are disposable containers, which are intended to be discarded after having been emptied of their contents.

A "particulate material" or "particulate product" should be broadly understood to include any material in the form of particles, granules, grinds, plant fragments, short fibres, flakes, seeds, pieces, etc. The particulate products which are suitable for packaging in the composite containers as disclosed herein are generally flowable non-liquid products, allowing a desired amount of the packaged product to be poured, scooped or taken by hand out of the composite container.

A composite container as disclosed herein may be a container for alimentary or consumable products such as infant formula, coffee, tea, rice, flour, sugar, rice, peas, beans, lentils, cereals, soup powder, custard powder, pasta, snacks, or the like. Alternatively, the packaged product may be non-alimentary, such as tobacco, detergent, dishwasher powder, fertilizer, chemicals, or the like.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, such as layers of materials are not necessarily drawn to scale. The steps in the method of forming a packaging container and the packaging container shown in the figures are provided as examples only and should not be considered limiting to the invention. Accordingly, the scope of invention is determined solely by the scope of the appended claims.

Figure 1A:
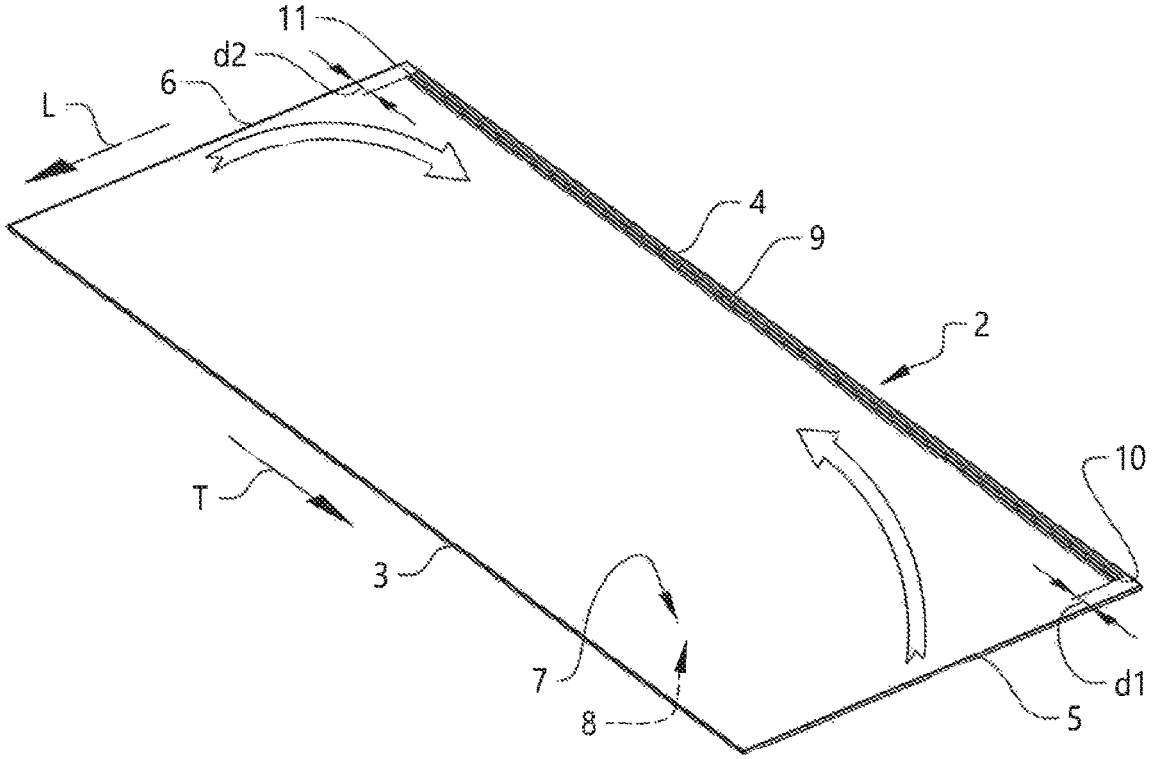
FIGS. 1*a*-1*g* illustrate steps in a method of forming a packaging container according to the present disclosure.
Figure 1B:
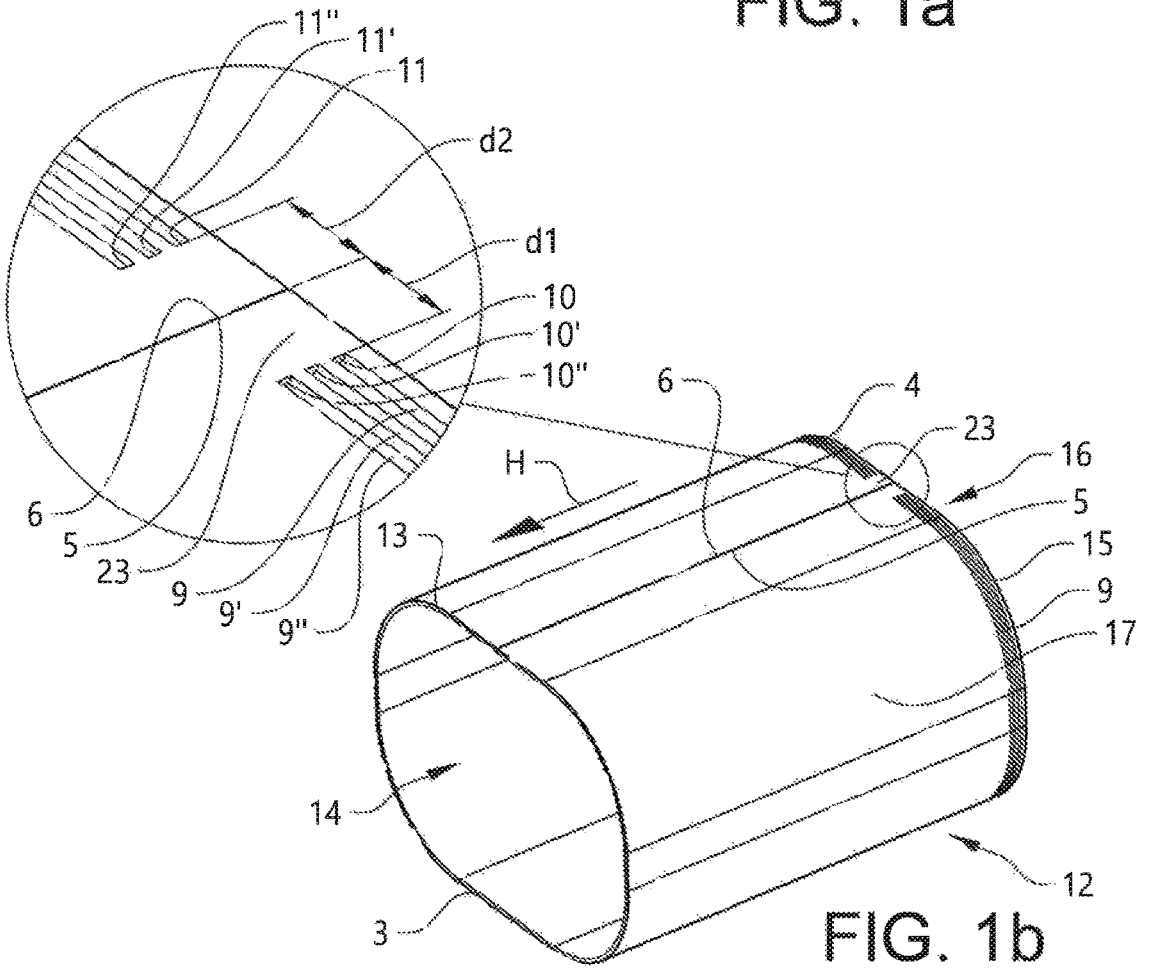

FIGS. 1*a*-1*g* illustrate a method of forming a packaging container 1 according to the present disclosure. FIG. 1*a* illustrates a rectangular body blank 2 having a longitudinal direction L and a transverse direction T. The body blank 2 has a top edge 3 and a bottom edge 4 and a first and a second side edge 5, 6, an inner surface 7 and an outer surface 8. The parallel crease lines 9 extend between respective first and second line end points 10, 11. The respective first line end points 10 are each arranged with a distance $d_1$ of from 2 mm to 15 mm from the first side edge 5 and the respective second line end points 11 are each arranged with a distance $d_2$ of from 2 mm to 15 mm from the second side edge 6. The method involves bending the rectangular paperboard body blank 2 shown into a tube 12 by bending together side edges 5, 6 of the paperboard sheet material 2, thus causing the material to assume a tubular shape as shown in FIG. 1*b*. The tube forming the tubular container body 12 has an upper end 13 with an upper body opening 14 and a bottom end 15 with a bottom body opening 16 and a container body wall 17 extending in a height direction H of the packaging container 1 between the upper body opening 14 and the bottom body opening 16. The container body wall 17 has an inner surface 18 and an outer surface 19, an upper end edge 20 and a bottom end edge 21. The side edges 5, 6 of the paperboard sheet material 2 are arranged in a but-to-but relationship. Between the respective first and second end points 10, 10', 10", 11, 11', 11" there is a non-creased area 23 bridging over the side edges 5, 6 of the paperboard sheet material 2. The container wall 17 is provided with three continuous and parallel crease lines 9,9',9". The three parallel crease lines each extend between their respective first and second end points 10, 10', 10", 11, 11', 11", the first end points 10, 10', 10" being provided with a distance $d_1$ from the first side edge 5 and the second end points 11, 11', 11" being provided with a distance $d_2$ from the second side edge 6. The first and the second distance $d_1$, $d_2$ being of from 2 mm to 15 mm. The first and the second distance $d_1$, $d_2$ may be the same or may differ from each other.

Figure 1C:
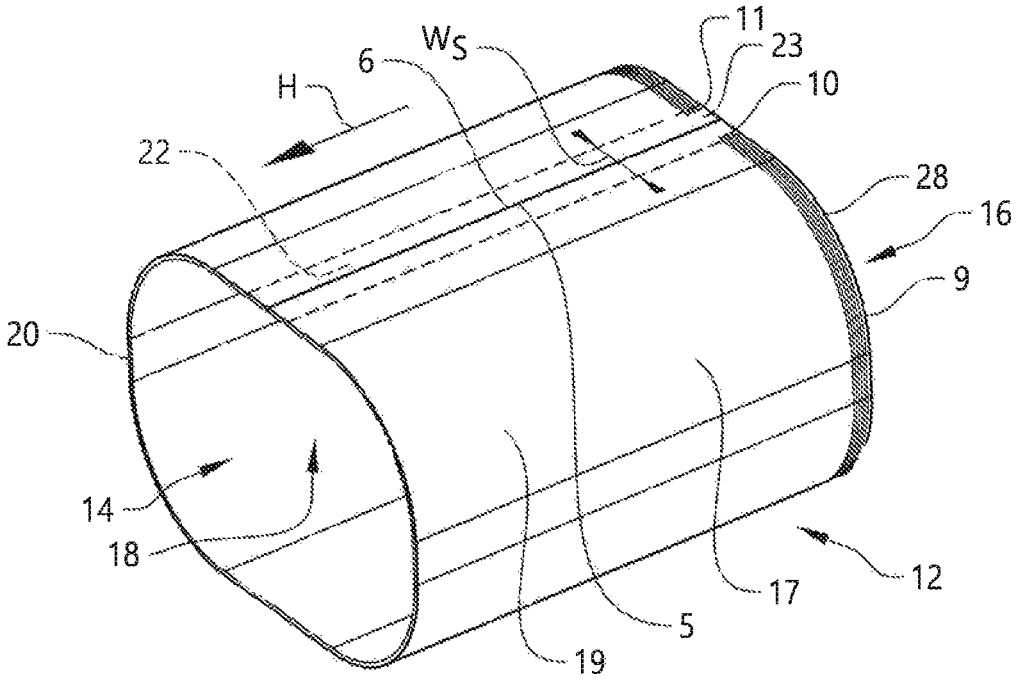

In FIG. 1*c*, the side edges 5, 6 of the paperboard body blank 2 is sealed in a but-to-but seal using a sealing strip 22 to form the tubular container body 12. The sealing strip 22 has a sealing strip width $w_s$, the sealing strip width $w_s$ corresponding essentially to the width of the non-creased area 23, i.e. $d_1+d_2$, and thus extends, in a width direction, between the respective first and second end points 10, 10', 10", 11, 11', 11", of the three continuous crease lines 9,9',9". The distance $d_1$ may, as illustrated in the figures herein, be the same for each of the first end points 10, 10', 10" and the distance $d_2$ may equally be the same for each of the first end points 10, 10', 10".

Figure 1D:
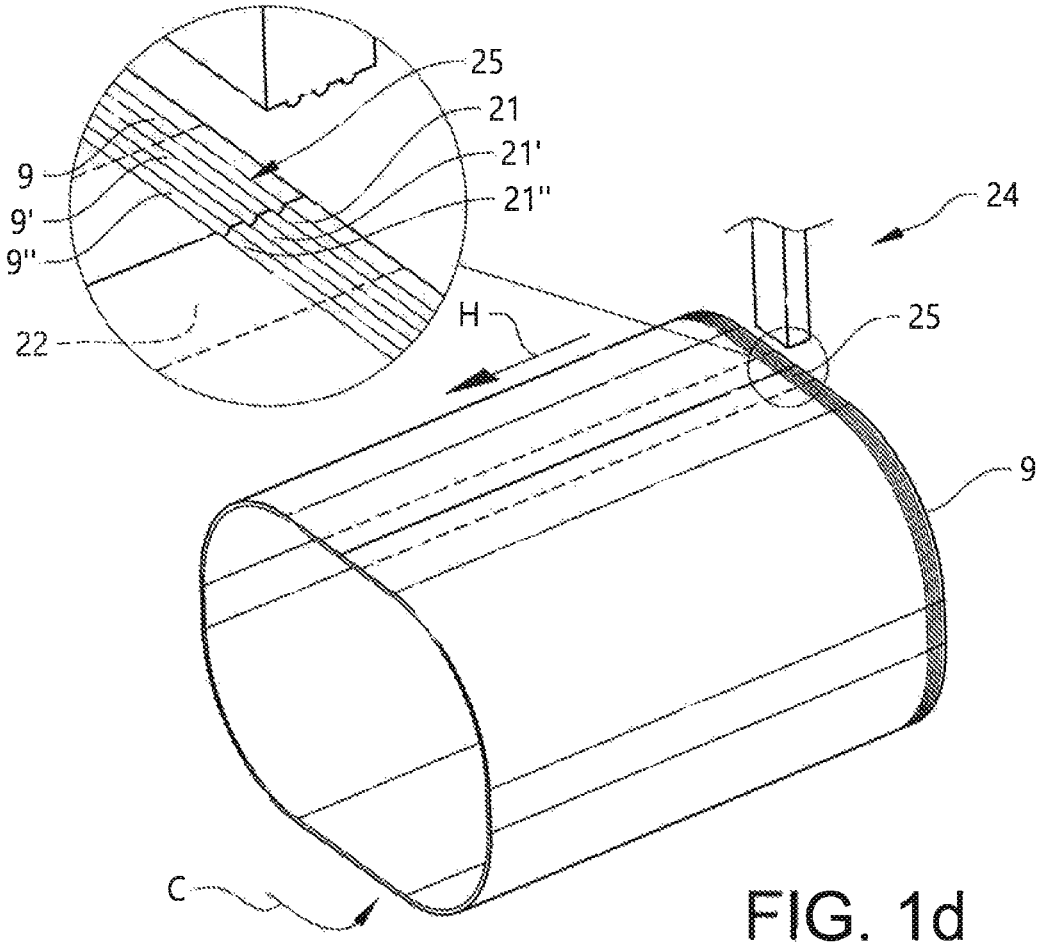

In FIG. 1*d*, the tubular container body 12 is presented to an embossing station 24 and the non-creased area 23 which is bridged by the sealing strip 22 and extending between the respective first and second end points 10, 10', 10", 11, 11', 11" is provided with bridging embossing lines 21, in this figure three bridging embossing lines 21, 21', 21", such that a bridging crease line area 25 is formed. The three bridging embossing lines 21, 21', 21" extend in a circumferential direction C, corresponding to the transverse direction T of the body blank. In FIG. 1*d*, the three bridging embossing lines 21, 21', 21" are aligned with the three crease lines 9,9',9", thus forming three closed loops.

Figure 1E:
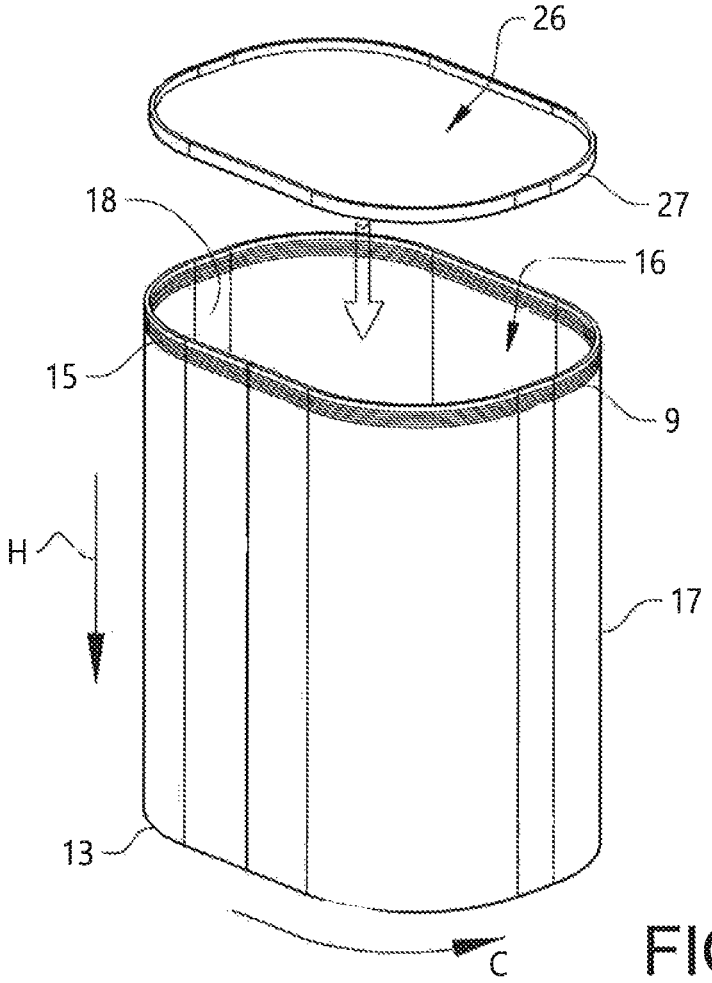

In FIG. 1*e*, the bottom body opening 16 is closed by pressing a bottom disc 26 into the bottom body opening 16. The bottom disc 26 has a peripheral flange 27 being flexed towards the bottom end 15 in the height direction H of the paperboard packaging container 1. Subsequently, the peripheral flange 27 of the bottom disc 26 is sealed to the inner surface 18 by means of high frequency welding. The bottom disc 26 is inserted such that the bottom disc 26 including the peripheral flange is arranged closer to the upper end 13 of the tubular container body 12 as compared to the parallel crease lines 9,9',9".

Figure 1F:
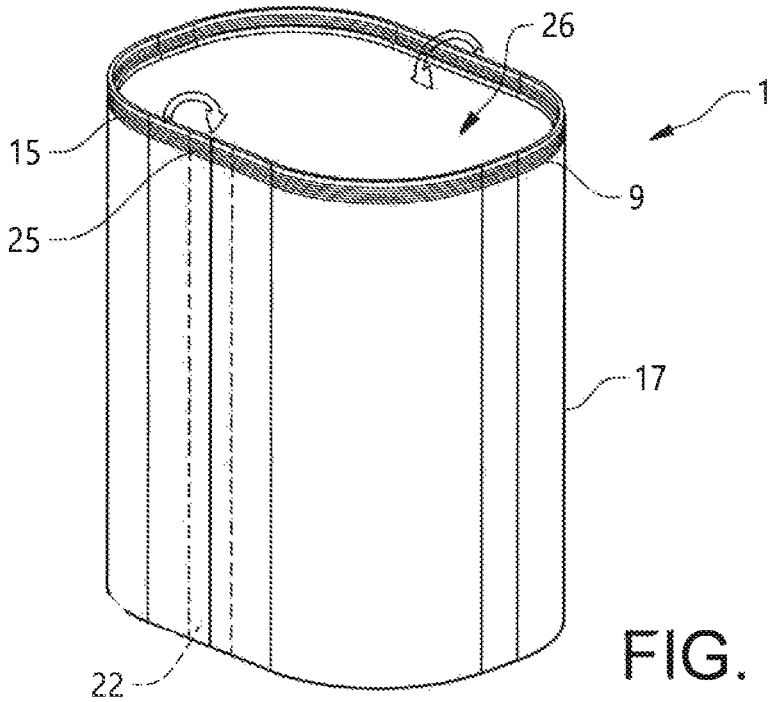
Figure 1G:
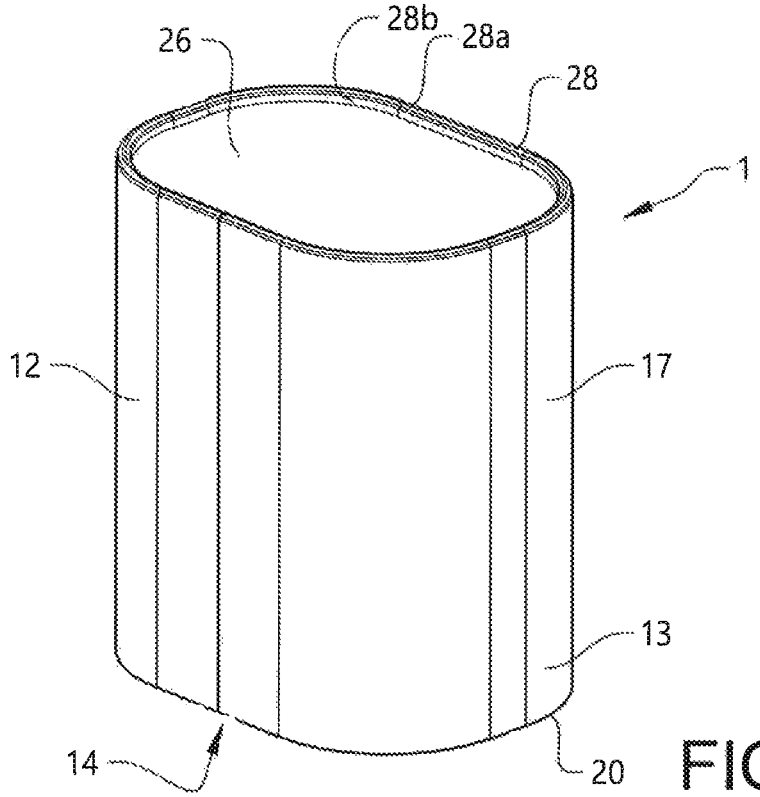

In FIG. 1*f* a curled bottom edge 28 is formed by folding or rolling the bottom end 15 of the container body wall 17 inwardly at the parallel crease lines 9,9',9" and at the bridging crease line area 25. The curled bottom edge 28 comprises an edge portion 28*a* and an inner portion 28*b* as illustrated in FIG. 1*g*. The packaging container 1 may in a subsequent step, not illustrated in the figures, be filled with bulk solids into the tubular container body 12 via the upper body opening 14. In a further step the upper body opening 14 is closed. The upper body opening 14 may for example in a first step be closed by pressing a paperboard top disc into the tube 12 at the upper end 13, the top disc having a peripheral flange being flexed towards the upper end 13 in the height direction H. The upper body opening 14 may alternatively or additionally be closed by applying a lid component to the upper end 13 of the tubular container body 12.

The method illustrated in FIGS. 1*a* to 1*g* illustrates forming a packaging container having a curled bottom edge, however the method may alternatively or additionally be providing a packaging container having a curled upper edge and wherein the tubular container body is provided with two or more parallel crease lines and a bridging crease line area including two or more bridging crease lines at the curled upper edge.

Figure 2:
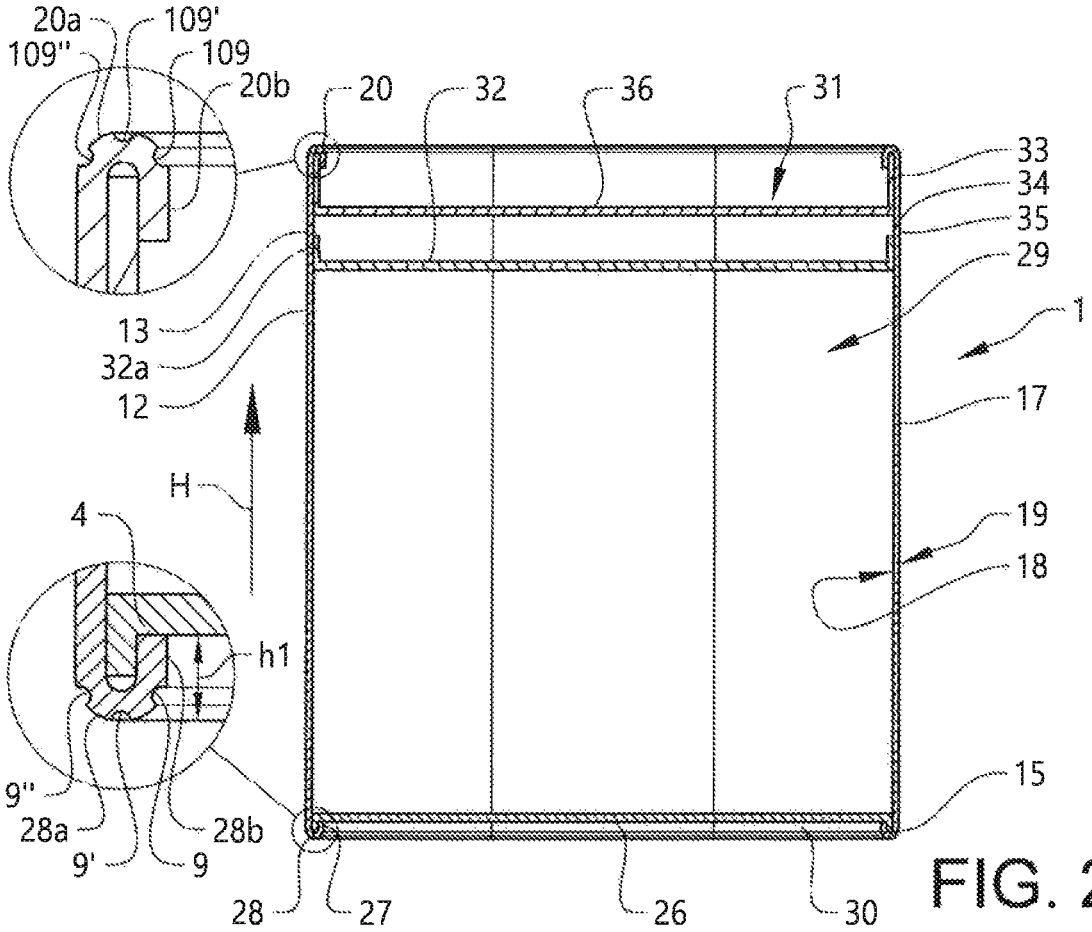
FIG. 2 illustrates a packaging container according to the present disclosure.

In FIG. 2, a paperboard packaging container 1 according to the present disclosure is shown. The packaging container 1 comprising a tubular container body 12, a container bottom 30 and a container lid 31. The container body 12 extends in a height direction H of the packaging container 1 from an upper end 13 to a bottom end 15. The tubular container body 12 comprises a container body wall 17. The container body wall 17 has an inner surface 18 facing towards an inner compartment 29 in the packaging container 1 and an outer surface 19 facing away from the inner compartment 29. The container body wall 17 has an upper end edge 20 and a bottom end edge 28. The tubular container body 12 comprises a but-to-but joint extending in the height direction H, the but-to-but joint being sealed by a sealing strip 22, see FIG. 1*b*. The container bottom 30 comprises a bottom disc 26 having a peripheral flange 27 being flexed towards the bottom end 15 in the height direction H and attached to the inner surface 18 of the container body wall 17. The second end 15, herein in the form of the bottom end 15 of the container body wall 17 has been curled or rolled inwardly to provide a curled bottom edge 28 comprising an edge portion 28*a* and an inner portion 28*b*. The inner portion 28*b* of the curled bottom edge 28 may have a height $h_1$ of about from 2 to 20 mm. The height $h_1$ is measured from the bottom edge of the body blank bottom edge 4 and to the edge portion 28*a*. The container wall 17 is provided with three circumferential and parallel crease lines 9,9',9" including a bridging area at the curled bottom edge 28. The three circumferential crease lines 9,9',9" are connected in a bridging crease line area 25 comprising three bridging parallel crease lines 21, 21', 21" bridging over the sealing strip 22, see FIG. 1*d*, such that the parallel crease lines 9, 21 extend continuously in a circumferential direction C around the circumference of the tubular container body 17. The packaging container 1 disclosed in FIG. 2 is provided with a partly or fully removable transport closure 32 being attached to the inner surface 18 of the container body wall 17. The transport closure 32 may be attached to the inner surface 18 of the container body wall 17 by means of a flexed peripheral edge portion 32*a* extending the height direction H of the paperboard packaging container 1. The lid 31 may be of the plug-in lid typ, comprising an outer circumferential lid collar 33 having a lid abutment edge 34, adapted to abut against a container body abutment edge 35, and a lid plug-in portion 36. An example of this kind of lid-type is disclosed in WO 2017/180056. The paperboard packaging container as disclosed in FIG. 2 is provided with a first curled edge 20, here a curled upper edge 20. The container wall 17 is provided with three circumferential crease lines 109, 109', 109". The container wall furthermore comprises a second bridging area comprising three bridging parallel crease lines bridging over the sealing strip 22 (not shown in the figure). The first curled edge 20 comprises an edge portion 20*a* and an inner portion 20*b*. Moreover, the lid may be of the removable kind, without any permanent connection to the container body. It is further to be understood that the closure arrangement as shown in FIG. 2 is non-limiting and that the bottom end as disclosed herein may be used for packaging containers having other types of closure arrangements such as closure arrangements wherein a lid cooperates with a reinforcement rim or with a frame structure of the container body to close and open the packaging container. The lid may be provided as a part of a lid component. A lid component comprises a rim to which the lid is connected with a hinge. The rim is attached to the container body and stabilizes the container opening. The lid component may be provided with features such as locking means for keeping the lid in a closed position, tamper evidence means, stacking means, etc. as known in the art. Lid components are usually formed by injection molding of thermoplastic material.

The invention claimed is:

1. A method of forming a paperboard packaging container from a rectangular body blank, the method comprising the steps of:

a) providing a rectangular body blank, the body blank having a longitudinal direction and a transverse direction, the body blank having a first transverse edge and a second transverse edge and a first and a second side edge, an inside surface and an outside surface, the body blank being made from a laminate sheet material comprising a carton substrate layer, the body blank comprising two or more parallel crease lines, the parallel crease lines extending along the second transverse edge between respective first and second line end points, the respective first line end points each being arranged with a distance ($d_1$) of from 2 mm to 15 mm from the first side edge and the respective second line end points each being arranged with a distance ($d_2$) of from 2 mm to 15 mm from the second side edge;

b) forming a tubular container body from the rectangular body blank, the container body having a first end with a first body opening and a second end with a second body opening and a container body wall extending in a height direction of the packaging container between the first body opening and the second body opening, the height direction of the packaging container corresponding to the longitudinal direction of the body blank, the container body wall having an inner surface and an outer surface, a first end edge and a second end edge;

c) sealing together the first and the second side edge in a but-to-but seal using a sealing strip having a sealing strip width, the sealing strip extending over a non-creased area bridging the first and the second side edge and extending between the first and second end points of the two or more parallel continuous crease lines, as seen in a circumferential direction of the paperboard packaging container corresponding to the transverse direction for the body blank;

d) presenting the tubular container body to a crease line forming station and providing the non-creased area bridging over the sealing strip and extending between the respective first and second end points with two or more bridging crease lines such a that a bridging crease line area is formed, extending in the circumferential direction;

e) closing the second body opening by pressing a paperboard disc into the second body opening, the paperboard disc having a peripheral flange being flexed towards the second end in the height direction of the paperboard packaging container and sealing the peripheral flange of the paperboard disc to the inner surface of the container wall;

f) forming a curled second edge by curling the second end of the container body wall inwardly, at the two or more parallel crease lines and at the crease line area, the curled second edge comprising an edge portion and an inner portion;

g) filling the packaging container with bulk solids;

h) closing the first body opening;

i) wherein steps h) and subsequently step g) could alternatively come after step d).

2. The method of forming a paperboard packaging container according to claim 1, wherein the two or more parallel crease lines provided in the body blank in step a) are three or more parallel continuous crease lines and wherein the two or more bridging crease lines in step e) are three or more bridging crease lines forming the bridging crease line area.

3. The method of forming a paperboard packaging container according to claim 1, wherein step f) includes folding or rolling the second end of the container body wall inwardly and over the peripheral flange of the paperboard disc.

4. The method of forming a paperboard packaging container according to claim 1, wherein the inner portion has a height ($h_1$) of from 2 mm to 20 mm, as measured between the second transverse edge of the body blank and the edge portion.

5. The method of forming a paperboard packaging container according to claim 1, wherein a distance between adjacent crease lines of the two or more parallel crease lines is between 0.5 and 4 mm, as seen in the height direction.

6. The method of forming a paperboard packaging container according to claim 1, wherein a distance between adjacent bridging crease lines of the two or more parallel bridging embossed lines is between 0.5 and 4 mm, as seen in the height direction.

7. The method of forming a paperboard packaging container according to claim 1, wherein the second transverse edge is a bottom edge, the second body opening is a bottom body opening, the second end edge is a bottom end edge, the paperboard disc is a bottom disc and the curled second edge is a curled bottom edge.

8. The method of forming a paperboard packaging container according to claim 1, wherein the second transverse edge is an upper edge, the second body opening is an upper body opening, the second end edge is an upper end edge, the paperboard disc is a top disc and the curled second edge is a curled upper edge.

9. The method of forming a paperboard packaging container according to claim 1, wherein the body blank in step a) furthermore is provided with two or more parallel crease lines extending along the first transverse edge between respective third and fourth line end points, the respective third line end points each being arranged with a distance of from 2 mm to 15 mm from the first side edge and the respective fourth line end points each being arranged with a distance of from 2 mm to 15 mm from the second side edge; and wherein step d) includes providing a second non-creased area bridging over the sealing strip and extending between the respective third and fourth line end points of the two or more parallel crease lines extending along the first transverse edge with two or more bridging crease lines such that a second bridging crease line area is formed, wherein step h) includes closing the first body opening by pressing a paperboard disc into the first body opening, the paperboard disc having a peripheral flange being flexed towards the first end in the height direction of the paperboard packaging container and sealing the peripheral flange of the paperboard disc to the inner surface of the container wall; the method further including a step of forming a curled first edge by curling the first end of the container body wall inwardly, at the two or more parallel crease lines arranged along the first transverse edge.

10. A paperboard packaging container for bulk solids, the container comprising a tubular container body, a container bottom and a container lid, the container body extending in a height direction of the container from a first end to a second end, the tubular container body comprising a container body wall, the container body wall having an inner surface facing towards an inner compartment in the packaging container and an outer surface facing away from the inner compartment, a first end edge and a second end edge, the tubular container body being made by a laminate sheet material comprising a carton substrate layer, and comprises a but-to-but joint extending in the height direction, the but-to-but joint being sealed by a sealing strip, a second body opening being closed with a paperboard disc having a peripheral flange being flexed towards the second end in the height direction and attached to the inner surface of the container body wall, the second end of the container body wall being curled inwardly providing a curled second edge comprising an edge portion and an inner portion characterized in that the container wall at the curled second edge and along a circumference of the tubular container body is provided with two or more parallel crease lines connected over a bridging area with two or more bridging parallel creased lines, the bridging area bridging over the sealing strip, such that the two or more parallel crease lines and the two or more bridging crease lines extend in a circumferential direction around the circumference of the tubular container body.

11. The paperboard packaging container according to claim 10, wherein the inner portion of the curled second edge has a height ($h_1$) of from 2 mm to 20 mm as measured from the edge portion to an end edge of the inner portion.

12. The paperboard packaging container according to claim 10, wherein the two or more circumferential and parallel crease lines are three or more circumferential and parallel crease lines and wherein the two or more bridging crease lines are three or more bridging crease lines.

13. The paperboard packaging container according to claim 10, wherein a distance between the circumferential and parallel crease lines are between 0.5 and 4 mm, as seen in the height direction and as measured between two adjacent crease lines.

14. The paperboard packaging container according to claim 10, wherein the second body opening is a bottom body opening, the second end edge is a bottom end edge, the paperboard disc is a bottom disc and the curled second edge is a curled bottom edge.

15. The paperboard packaging container according to claim 10, wherein the second body opening is an upper body opening, the second end edge is an upper end edge, the paperboard disc is a top disc and the curled second edge is a curled top edge.

16. The paperboard packaging container according to claim 10, wherein the first end of the container body wall is curled inwardly providing a curled first edge comprising an edge portion and an inner portion characterized in that the container wall at the curled first edge and along a circumference of the tubular container body is provided with two or more parallel crease lines connected over a second bridging area with two or more bridging parallel crease lines, the second bridging area bridging over the sealing strip, such that the two or more parallel crease lines and the two or more bridging crease lines extend in a circumferential direction around the circumference of the tubular container body.

* * * * *